United States Patent [19]

Durant

[11] Patent Number: 4,469,147

[45] Date of Patent: Sep. 4, 1984

[54] NON-INFLUENCING SPOUT FOR A WEIGHING FEED SYSTEM

[76] Inventor: Will G. Durant, 148 N. C St., Tustin, Calif. 92680

[21] Appl. No.: 371,751

[22] Filed: Apr. 26, 1982

[51] Int. Cl.[3] ..... B65B 1/32

[52] U.S. Cl. ..... 141/83; 141/374; 177/179

[58] Field of Search ..... 141/83, 374, 67, 16, 141/250-310, 114, 68, 392, 313-317; 222/77; 177/179; 277/DIG. 4, DIG. 6, 237 A, 212 FB

[56] References Cited

FOREIGN PATENT DOCUMENTS 2745685 4/1979 Fed. Rep. of Germany ..... 141/83

*Primary Examiner*—Houston S. Bell, Jr.

*Attorney, Agent, or Firm*—Leonard Tachner

[57] ABSTRACT

A novel seal, weighing tube and filling tube for a weighing feed system spout advantageously used for simultaneously filling and weighing bags with particulate material. The seal is an annularly shaped non-resilient member installed between the exit ends of the tubes to prevent accumulation of particulate material which would otherwise adversely affect the accuracy of the weight measurement. The seal is made of a non-influencing material such as dacron, silk, cotton or the like to preclude weight measurement inaccuracy. The weighing and filling tubes are provided with unique seal retainer rings which provide for retention of the seal by means of an effective gathering such as a drawstring on the filling tube and an O-ring on the weighing tube. An optional tool is disclosed for facilitating seal installation.

3 Claims, 5 Drawing Figures

NON-INFLUENCING SPOUT FOR A WEIGHING FEED SYSTEM

BACKGROUND OF THE INVENTION

1. Field of the Invention

The present invention pertains generally to feed systems that may be used for filling a bag with a particulate material and more specifically, to a filling spout for a feed system that provides for automatic weighing of the bag being filled without influencing the measurement accuracy of the bag weight.

2. Prior Art

Systems for feeding a particulate material such as fertilizer into a bag and for providing automatic weighing of the bag as it is being filled are well-known in the art. By way of example, U.S. Pat. No. 3,618,684 to Burke, et al discloses a bag filling apparatus wherein charges of material are successively weighed out by a scale and dispensed into a feed tank having a spout or nozzle upon which an empty bag is mounted. Similarly, U.S. Pat. No. 3,474,836 to Schwake, et al discloses a bag filling machine for handling bulk materials and in which the material to be packed is automatically weighed and then run through a funnel conduit into the bag which is held upon the discharge spout of the funnel conduit. Another such example is disclosed in U.S. Pat. No. 2,705,607 to Inglett.

It is also considered conventional in the prior art to provide a bag filling machine having means for automatic weighing of the bag contents utilizing feed mechanisms such as an auger feed screw, impeller, or pneumatic device for conveying the particulate material through a filling tube into the bag. In an auger feed screw bag filling apparatus it is well-known to provide a second tube outside of and coaxial with the auger feed screw tube which is spaced from the latter two and connected by well-known means to an automatic weighing apparatus. In such configurations the bag to be filled is, typically, placed over the weighing tube which is spaced from the filling tube to permit the bag contents to be weighed while substantially unaffected by the auger feed screw filling tube, the feed screw or any particulate material still in the auger feed tube that has not yet entered the bag and should therefore not contribute to the measured weight. In such prior art configurations it has become well-known to provide means for sealing the cylindrical space between the filling tube and the weighing tube to prevent the accumulation of particulate material therein which would otherwise inadvertently affect the weight measurement rendering the bag weighing process less accurate. In order to provide the aforementioned seal, prior art devices of the type described normally utilize an annularly-shaped resilient material such as neoprene which, as will be seen hereinafter, is commonly glued or otherwise affixed to the respective facing surfaces of the weighing tube and filling tube adjacent the exits thereof to prevent the flow of particulate material into the aforementioned space therebetween. Until recently this was believed to be a satisfactory solution to the aforementioned problem of inaccurate weighing of bags being filled by an auger feed screw feed system.

More recently however, particularly with the advent of extremely accurate and precise electronic weighing systems such as those that use load cells and microprocessor controlled electronic circuitry, it has been found that although the aforementioned prior art seal does not permit the particulate material to accumulate between the tubes and thereby detrimentally affect the accuracy of the weighing process, the resiliency of the seal itself provides an inadvertent spring affect between the tubes which tends to resist the movement of the weighing tube and thereby results in a lower measured weight than the actual weight of the bag contents. Therefore, the aforementioned resilient seal of the prior art prevents one source of bag weighing inaccuracy but only by creating a second such source which still prevents a truly accurate weight measurement of the bag contents while the bag is being filled by an auger feed screw or other type of feed system.

SUMMARY OF THE INVENTION

The present invention comprises a unique filling spout for a bag filling feed system and utilizes a novel non-resilient seal that not only prevents the accumulation of particulate material between the weighing tube and filling tube of such a system, but also entirely avoids the aforementioned detrimental influence that the prior art resilient seal has on the accuracy of the weighing process. More specifically, the present invention utilizes a uniquely structured weighing tube and filling tube designed to retain therebetween a non-resilient sealing material such as silk, dacron, cotton and the like. Because non-resilient material seals do not lend themselves to self-supporting adhesion to the facing surfaces of the weighing and filling tubes as in the prior art resilient seals, the weighing and filling tubes of the present invention provide unique seal retainers which permit retention of the seal between the tubes at the exit of the filling spout by means of an O-ring and a drawstring or similar gathering as will be more fully understood hereinafter.

OBJECTS

It is therefore a principal object of the present invention to provide a truly non-influencing spout for a weighing feed system for delivering a particulate material into a bag to be filled therewith and which entirely avoids or substantially overcomes the aforementioned disadvantages of the prior art.

It is another object of the present invention to provide a filling spout for a bag filling apparatus and which employs a non-resilient seal to both prevent the accumulation of the particulate material between the filling and weighing tubes thereof and also prevent any influence on the weighing measurement accuracy.

It is still an additional object of the present invention to provide a non-influencing seal to prevent the accumulation of particulate material between the weighing and filling tubes of a bag filling system whereby to also prevent the seal from having any affect on the accuracy of the weighing process and further to provide a novel structure in the weighing and filling tubes thereof for retaining the seal in relative flexible engagement therebetween.

BRIEF DESCRIPTION OF THE DRAWINGS

The aforementioned objects and advantages of the present invention as well as additional objects and advantages thereof will be more fully understood hereinafter as a result of a detailed description of a preferred embodiment of the invention when taken in conjunction with the accompanying drawings in which.

DETAILED DESCRIPTION OF A PREFERRED EMBODIMENT

Figure 1:
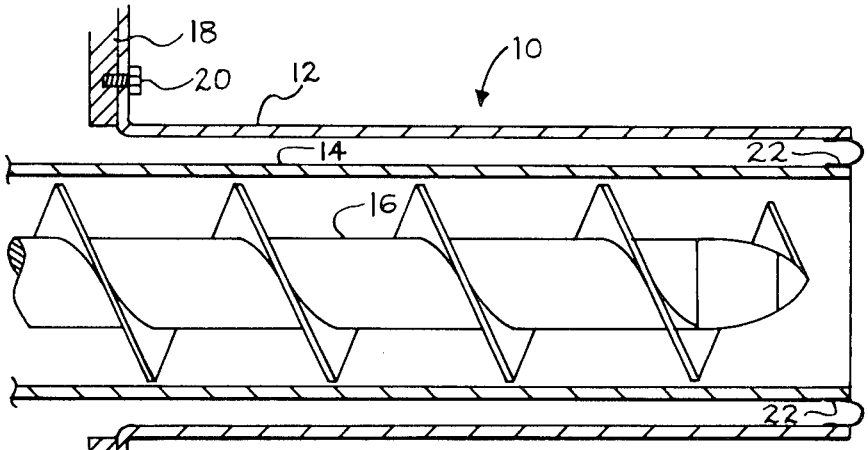
FIG. 1 (PRIOR ART)
FIG. 1 is a cross-sectional side view of an auger feed screw bag filling feed system of the prior art.

Referring to FIG. 1 there is shown a prior art spout 10 for a weighing feed system of the type described. More specifically, as seen in FIG. 1 the spout comprises a weighing tube 12, a filling tube 14, an auger feed screw 16 and a scale fixture 18. As is well-known in the art it is common for a bag to be filled by the feed system spout shown in FIG. 1, to have its opening placed over the outer surface of weighing tube 12 so that auger feed screw 16 can convey particulate material from a hopper or the like (not shown) to which filling tube 14 is connected. Weighing tube 12 is connected to a scale fixture 18 by means such as bolts 20 so that as the bag is being filled the bag contents may be weighed continuously. It is typical to provide circuitry for automatically stopping the filling process, that is, by stopping the rotation of auger feed screw 16, when a desired weight for the bag contents has been achieved when measured by the scale (not shown) to which scale fixture 18 is connected.

As further shown in FIG. 1 weighing tube 12 and filling tube 14 comprise cylinders that are mechanically independent from one another being spaced to permit movement of weighing tube 12 relative to filling tube 14 as a result of the force imparted by the weight of the bag being filled. Of course, those having skill in the art to which the present invention pertains will realize that any substantial accumulation of particulate material in the region between the facing surfaces of tubes 12 and 14 would tend to detrimentally affect the accuracy of the weighing process by obstructing the movement of weighing tube 12 relative to filling tube 14 and also by adding to the weight force imparted to weighing tube 12 that contributes to the resultant weight measurement without actually being contained within the bag being filled. It is for this reason that a seal 22, has in the prior art, come to be placed in the annular exit region between tubes 12 and 14 substantially in the manner shown in FIG. 1. Seal 22 is resilient in structure typically being of such materials as neoprene and the like. Thus, although annular seal 22 is effective in preventing the aforementioned accumulation of particulate material in the region between tubes 12 and 14, the resiliency of the seal, particularly in the flexed state illustrated in FIG. 1, contributes a measurable resistance to the movement of tube 12 relative to tube 14 thereby contributing a significant error to the weight measurement. By way of example, it has been found that an error of approximately 0.2 to 0.3 pounds occurs commonly in the process of weighing out a fifty pound bag of particulate material being filled by a prior art feed system of the type shown in FIG. 1.

Figure 2:
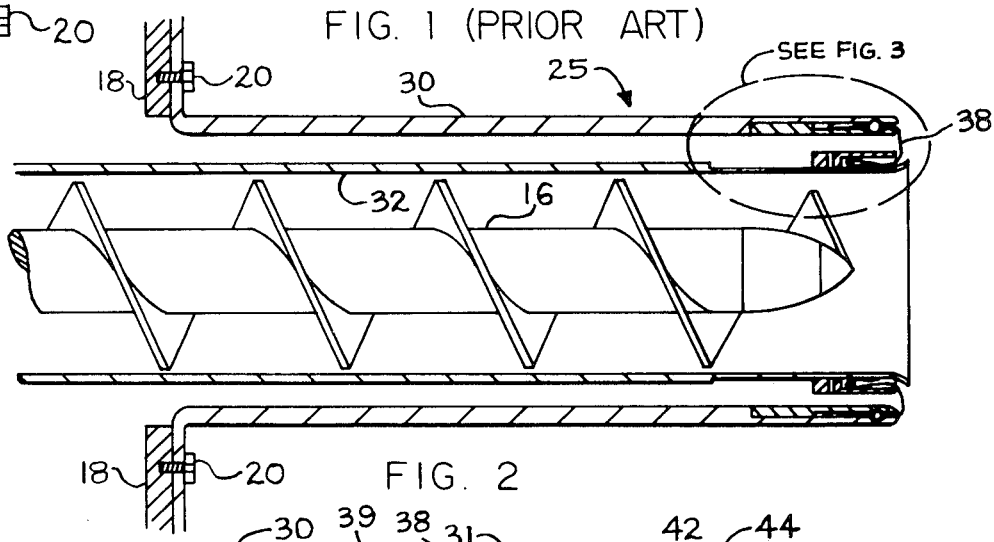
FIG. 2 is a similar view of a bag filling feed system employing the present invention.
Figure 3:
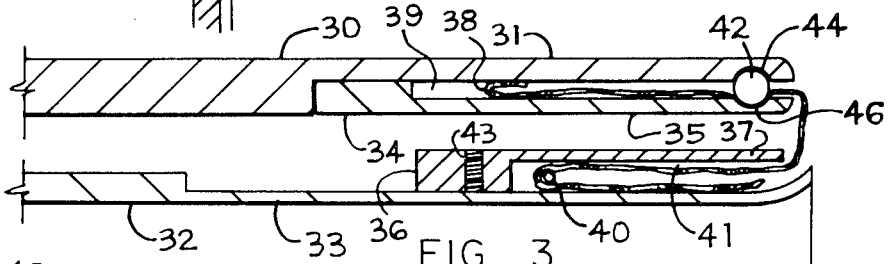
FIG. 3 is an enlarged cross-sectional view of portions of the weighing tube and filling tube and of the seal of the present invention.

It will be seen hereinafter that in the present invention a unique non-resilient and therefore non-influencing seal is provided which not only prevents the aforementioned accumulation of particulate material between the weighing and filling tubes, but also prevents any inadvertent influence on the weighing measurement as a result of resistance to the relative movement to the weighing tube as previously described for the prior art seal 22 of FIG. 1. It will also be seen hereinafter that the present invention provides unique modifications to the weighing and filling tubes to permit secure engagement of the non-resilient seal of the invention to those tubes. More specifically, as seen in FIGS. 2 and 3 in the non-influencing spout 25 of the present invention, a new weighing tube 30 and a new filling tube 32 are provided and include means for securing a non-resilient sealing material such as silk, dacron, cotton or the like. As seen in FIGS. 2 and 3, a novel seal 38 made of such material is also secured between the exit portions of weighing tube 30 and filling tube 32 to prevent the accumulation of particulate material therebetween. However, as seen best in FIG. 3, because seal 38 is made from a non-resilient material, it does not offer any resistance to the movement of weighing tube 30 relative to filling tube 32 in response to the force exerted thereon by the weight of the bag contents as the bag is being filled by the present invention. As seen in FIG. 2, the method of operation of the filling system with which the present invention is utilized is essentially the same as that described for the prior art device shown in FIG. 1. More specifically, weighing tube 30 is attached to the scale fixture 18 by means of bolts 20 and is located spaced from and coaxial to filling tube 32 which houses auger feed screw 16 and which is connected to a suitable source of particulate material such as a hopper (not shown), to deliver the particulate material to a bag, the open end of which may be placed over the outside surface of weighing tube 30. Although the present invention may be used advantageously with virtually any feed system and weighing apparatus, it is especially advantageous in such systems where the weighing apparatus is electronic and uses a load cell ratio mechanism for minimizing the motion of the weighing tube.

In addition to the aforementioned difference between the non-resilient seal of the present invention and the resilient rubberized seal of the prior art, an important distinction between the present invention and the prior art device shown in FIG. 1 resides in the manner in which the non-resilient seal 38 is secured to weighing tube 30 and to filling tube 32. More specifically, as seen in FIG. 3, weighing tube 30 comprises a weighing tube seal retaining ring 34 which is affixed to the weighing tube along a reduced thickness portion 31 of the tube. As seen further in FIG. 3, weighing tube seal retaining ring 34 also includes a reduced thickness or narrow portion 35 resulting in a cylindrical gap 39 between retainer ring 34 and weighing tube 30, and gap 30 is adapted to receive one end of non-resilient seal 38. As seen further in FIG. 3 filling tube 32 also includes a narrow portion 33 to which is connected a filling tube seal retainer ring 36 at the exit end thereof. Seal retainer ring 36 also includes a narrow portion 37 forming a second cylindrical gap 41 adjacent filling tube 32 to receive the other end of non-resilient seal 38. Seal retaining rings 34 and 36 may be affixed to the respective tubes by either epoxy or by mechanical means such as set screw 43.

As also shown in FIG. 3, seal 38 is preferably secured to the outer surface of filling tube 32 by means of a drawstring 40 or similar gathering which may be taped or sewn into an overlapped, folded edge of seal 38 and which may be drawn into compressive engagement with filling tube 32 around the periphery thereof in a well-known manner. It will be observed that drawstring 40 may be optionally replaced by a flexible band such as a rubber band or other appropriate expandable material of suitable length to provide a tight fit around the periphery of filling tube 32 to secure the seal 38 thereagainst. The other portion of seal 38 that is adapted for location within gap 39 between weighing tube 30 and weighing tube seal retainer ring 34 is held in place by an O-ring 42 which is adapted to be secured in a groove comprising annular depression 44 in weighing tube 30 and annular depression 46 in seal retainer ring 34. It is seen in FIG. 3 that relative positions of O-ring 42 and the free end of narrow portion 37 of seal retainer ring 36 cause seal 38 to be held in substantially contiguous relation with the adjacent free ends of tubes 30 and 32. In this configuration, seal 38 cannot be inadvertently flexed into the region between the tubes which could otherwise permit the undesirable accumulation of particulate material.

Figure 4:
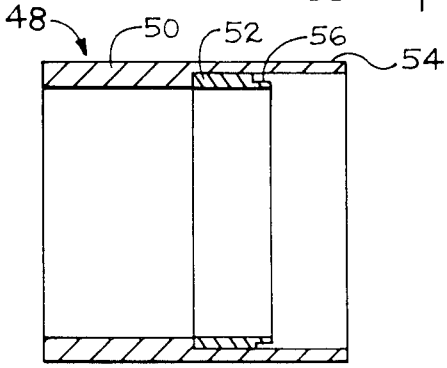
FIGS. 4 and 5 are a cross-sectional side and end views respectively of an O-ring retention tool which may be advantageously used for installing the present invention.
Figure 5:
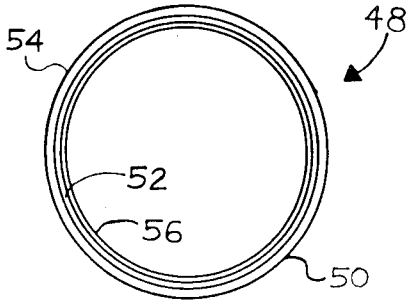

Although it is quite possible to install seal 38 in the manner shown in FIGS. 2 and 3 without the use of any special tools, it has been found advantageous to use a simple cylindrically shaped tool for retaining O-ring 42 within the annular depressions 44 and 46 during installation of seal 38. The cylindrical O-ring retention tool 48 is shown in FIGS. 4 and 5 and comprises an outer cylinder 50 and an inner cylinder 52 which is affixed to outer seal 50 in coaxial contiguous engagement therewith. Outer cylinder 50 and inner cylinder 52 each have a narrow portion extending therefrom to form a weighing tube ring 54 and an O-ring retaining ring 56, respectively. Weighing tube ring 54 is designed to overlie weighing tube 30 is substantial engagement with the outer face thereof while O-ring retainer ring 56 extends sufficiently into gap 39 to retain O-ring 42 within the annular depressions 44 and 46 while seal 38 is being installed.

Although there are a number of ways in which the seal 38 of the present invention may be installed, it has been found preferable to first place the inner edge of annular seal 38 into the cylindrical gap 41 between filling tube 32 and seal retainer ring 36 and to then tighten the sewn portion of seal 38 around the outer periphery of filling tube 32 by pulling the drawstring 40 into a tighten position and securing it such as by means of a conventional knot. This first step in the process may be more conveniently be carried out if it is done before weighing tube 30 is secured in its coaxial position shown in FIG. 2. The next step is then to place the opposite edge or outer annular edge of seal 38 in gap 39 between weighing tube 30 and seal retainer ring 34. The installation is then completed by placing O-ring 42 at the entrance to gap 39 and pushing it into the region between annular depressions 44 and 46 by means of tool 48. O-ring 42 permits some adjustment in the area of seal 38 between annular gaps 39 and 41. However, it is preferable to adjust the relative position of O-ring 42 and seal 38 so that when the O-ring and seal are in their installed positions as seen in FIG. 3, the portion of seal 38 between gaps 39 and 41 is substantially vertical but not taut. Thus, seal 38 should have insufficient play to create any moment on the weighing tube or scale but should not have enough play to permit any collection of particulate material on a portion of the seal flexed between tubes 30 and 32.

It will now be understood that what has been disclosed herein comprises a non-influencing spout for a weighing feed system of the type that utilizes coaxial weighing and filling tubes, the latter housing a feed mechanism such as an auger feed screw for delivering particulate material to a bag to be filled. The invention resides primarily in an improved seal of annular shape that is used to prevent the accumulation of particulate material between the aforementioned tubes but which also prevents any inadvertent influence on the accuracy of the weighing process that occurs using prior art resilient seals. Other inventive features comprise novel structure in the weighing and filling tubes to provide means for securing the non-resilient seal of the present invention therebetween. A cylindrical tool that may optionally be used to aid in installation of the seal of the present invention has also been disclosed.

It will now be clear to those having skill in the art to which the present invention pertains, that many modifications and/or additions may be made to the invention without departing from the scope of protection contemplated herein. By way of example, it will now be apparent to those familiar with the feed system art that there are numerous other ways of securing a non-resilient seal of the type disclosed to the weighing and filling tubes of the feed system. In addition, as a result of the teaching herein disclosed, materials other than those specifically disclosed herein and that are suitable for use as a non-resilient seal will now come to mind. However, it is to be understood that all such additions and/or modifications are contemplated to be within the scope of the invention which is to be limited only by the claims appended hereto.

I claim:

1. In a spout apparatus of the type used for filling and weighing a bag with particulate material and having a pair of coaxial tubes, the inner tube of which is a filling tube for conveying the particulate material from a source to the bag and the outer tube of which is a weighing tube supporting the bag as it is being filled and connected to a scale for concurrently weighing the bag; an improved sealing apparatus for prevention of the accumulation of the particulate material between the tubes, the sealing apparatus comprising:

an annular seal of non-resilient material, means on the outer surface of said filling tube for retaining an edge of said seal to said filling tube, and means on the inner surface of said weighing tube for retaining the remaining edge of said seal to said weighing tube, said filling tube and weighing tube means having means for locating the annular mid-portion of said seal in substantially contiguous relation to the adjacent edges of said tubes, respectively, said means on said filling tube comprising a retainer ring coaxially affixed to the outer surface of said filling tube and having a ring portion of reduced thickness extending toward and terminating adjacent the exit end of said filling tube whereby to form a first cylindrically shaped gap for receiving an edge of said seal, said means on said weighing tube comprising a retainer ring coaxially affixed to the inner surface of said weighing tube and having a ring portion of reduced thickness extending toward and terminating adjacent the exit end of said weighing tube whereby to form a second cylindrically shaped gap for receiving the remaining edge of said seal, said means for locating comprising a gathering on said filling tube and an O-ring on said weighing tube, the gathering being selectively drawn taut around the periphery of said filling tube within said first cylindrically shaped gap for securing said seal to said filling tube, and the O-ring being located coaxially around the inner surface of the weighing tube and being in frictional engagement with and located between said inner surface of said weighing tube and the retainer ring affixed thereto within said second cylindrically shaped gap.

2. The improved sealing apparatus recited in claim 1 further comprising:

respective aligned, coaxial, annular depressions in said weighing tube and said retainer ring affixed to said weighing tube, respectively, whereby to form an annular groove in said second cylindrically shaped gap for receiving said O-ring.

3. An improved spout apparatus of the type used for filling a bag with a particulate material and for weighing the bag's contents during the filling process; the apparatus comprising:

a feed apparatus for conveying the particulate material from a source to a bag, a filling tube coaxially housing said feed apparatus for containing said particulate material being conveyed to a bag, and having a free end for delivery of said particulate material into said bag, a weighing tube radially spaced from and coaxial with said filling tube and having a free end terminating adjacent said free end of said filling tube for supporting said bag while the bag is being filled, the weighing tube being connected to a scale for weighing said particulate material contained within said bag, a non-resilient seal of annular configuration connected between the respective free ends of said filling and weighing tubes for preventing the accumulation of said particulate material between said tubes, and means on said weighing tube and on said filling tube for retaining said seal in substantially contiguous relation with the adjacent free ends of said tubes, respectively, wherein said seal in connected between said free ends by an O-ring on said weighing tube and a drawstring on said filling tube, said drawstring being selectively drawn taut around the periphery of said filling tube for securing said seal to said filling tube and said O-ring being located coaxially around the inner surface of said weighing tube and being in frictional engagement with and located between the inner surface of said weighing tube and said retaining means.

* * * * *